US010833450B2

(12) United States Patent
Mase

(10) Patent No.: US 10,833,450 B2
(45) Date of Patent: Nov. 10, 2020

(54) CONNECTOR WITH CONNECTION DETECTING MEMBER

(71) Applicant: Sumitomo Wiring Systems, Ltd., Mie (JP)

(72) Inventor: Tsuyoshi Mase, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/612,793

(22) PCT Filed: May 15, 2017

(86) PCT No.: PCT/JP2017/018203
§ 371 (c)(1),
(2) Date: Nov. 12, 2019

(87) PCT Pub. No.: WO2018/211560
PCT Pub. Date: Nov. 22, 2018

(65) Prior Publication Data

US 2020/0203885 A1 Jun. 25, 2020

(51) Int. Cl.

| | |
|---|---|
| ***H01R 13/627*** | (2006.01) |
| ***H01R 13/502*** | (2006.01) |
| ***H01R 13/639*** | (2006.01) |
| ***H01R 13/641*** | (2006.01) |

(52) U.S. Cl.
CPC ..... *H01R 13/6272* (2013.01); *H01R 13/502* (2013.01); *H01R 13/639* (2013.01); *H01R 13/641* (2013.01)

(58) Field of Classification Search
CPC ..... H01R 13/6271; H01R 13/6275
USPC ..... 439/489, 352
See application file for complete search history.

(56) References Cited

U.S. PATENT DOCUMENTS 5,605,472 A 2/1997 Sakai et al.
6,435,895 B1 * 8/2002 Fink ..... H01R 13/6272 439/352

FOREIGN PATENT DOCUMENTS

| | | |
|---|---|---|
| JP | 8-31517 | 2/1996 |
| JP | 2016-225027 | 12/2016 |
| WO | 2014/181408 | 11/2014 |

OTHER PUBLICATIONS

International Search Report dated Jul. 25, 2017.

* cited by examiner

*Primary Examiner* — Phuong K Dinh
(74) *Attorney, Agent, or Firm* — Gerald E. Hespos; Michael J. Porco; Matthew T. Hespos

(57) ABSTRACT

A connection detecting member (30) is mounted on a support (20) of a lock arm (15) to be integrally resiliently displaceable, and relatively movable with respect to the support (20) between an initial position and a detection position. A resilient locking piece (32) of the connection detecting member (30) restricts a movement of the connection detecting member (30) to the detection position by contacting a front stop (19) of the lock arm (15) in a state where both housings (10, 50) are not connected or are connected incompletely. The first housing (10) is provided with a movement restricting portion (23) for restricting a movement of the connection detecting member (30) toward the detection position by contact with the connection detecting member (30) when the resilient locking piece (32) is displaced in a separating direction from the front stop (19) due to curved deformation of the lock arm (15).

13 Claims, 18 Drawing Sheets

CONNECTOR WITH CONNECTION DETECTING MEMBER

BACKGROUND

Field of the Invention

The present invention relates to a connector.

Related Art

Japanese Unexamined Patent Publication No. H08-031517 discloses a connector with a male connector housing including a flexible lock arm, a female connector housing connectable to the male connector housing, and a connection detecting member for detecting a connected state of the connector housings. The connection detecting member is supported on a rear end part of the flexible lock arm so as to be integrally resiliently displaceable and slidable between an initial position and a detection position forward of the initial position. A flexible detection arm is cantilevered forward on the connection detecting member and is formed with a lock protrusion.

The front end of the flexible detection arm butts against the lock protrusion in a state where the connector housings are not connected or are connected incompletely so that the connection detecting member is held at the initial position. The flexible lock arm locks an engaging protrusion of a second housing when the connector housings reach a properly connected state so that the connector housings are locked in the properly connected state. The flexible lock arm separates from the lock protrusion due to interference with the engaging protrusion when the connector housings are connected properly. Thus, the connection detecting member can move to the detection position. According to this configuration, the connected state of the connector housings can be detected based on whether or not the connection detecting member can be moved to the detection position.

In the above-described connector, a wire or the like can caught by the lock arm or the connection detecting member with the connection detecting member held at the initial position and in the state where the connector housings are not connected. Thus, there is a possibility that the flexible lock arm is curved and deformed and separated from the lock protrusion. If the flexible lock arm is separated from the lock protrusion, the connection detecting member is not held at the initial position and may be pushed to the detection position even though the connector housings are not connected. If the connector housings are connected with the connection detecting member pushed to the detection position, the connected state of the connector housings cannot be detected.

The invention was completed on the basis of the above situation and aims to improve the reliability of a connection detecting function by a connection detecting member.

SUMMARY

The invention is directed to a connector with a first housing and a second housing connectable to the first housing from the front. A lock is formed in the second housing, and a lock arm formed on the first housing. The lock arm can engage the lock for locking the first housing and the second housing in a properly connected state. The lock arm is resiliently displaceable in an unlocking direction to be separated from the lock. A support is formed on a rear part of the lock arm. A connection detecting member is mounted on the support to be integrally resiliently displaceable in the unlocking direction. The connection detecting member is movable with respect to the supporting portion between an initial position and a detection position forward of the initial position. A front stop is formed on the lock arm at a position forward of the support in a front-rear direction. A resilient locking piece projects forward from a body of the connection detecting member supported on the support. The resilient locking piece is capable of restricting a movement of the connection detecting member at the initial position to the detection position by contacting the front stop in a state where the first housing and the second housing are not connected or are connected incompletely and allows movement of the connection detecting member to the detection position by being resiliently displaced in a separating direction from the front stop due to interference with the lock in a state where the first housing and the second housing are connected properly. A movement restricting portion is formed on the first housing and restricts movement of the connection detecting member toward the detection position by contacting the connection detecting member when the resilient locking piece is displaced in the separating direction from the front stop due to curved deformation of the lock arm.

Movement of the connection detecting member from the initial position to the detection position is restricted by contact with the movement restricting portion even if the lock arm is curved and deformed due to the interference of external matter or the like and the resilient locking piece is separated from the front stop. There is no possibility that the connection detecting member is pushed to the detection position in the state where the housings are not connected. Thus, the reliability of a connection detecting function by the connection detecting member is excellent.

An inversion restricting portion may be formed on the movement restricting portion to restrict displacement of the lock arm in an inverting direction opposite to the unlocking direction. Thus, the shape of the first housing can be simplified as compared to the case where a dedicated inversion restricting portion is formed at a location different from the movement restricting portion.

The connection detecting member may be made of synthetic resin and may include butting portions, such as projecting ribs, that are capable of contacting the movement restricting portion. According to this configuration, a contact part of the connection detecting member with the movement restricting portion is divided into the butting portions in the form of projecting ribs. Thus, a sink is not likely to be formed when molding the connection detecting member.

An unlocking surface may be formed on an outer surface of the connection detecting member for unlocking the lock arm from the lock by resiliently displacing the lock arm in the unlocking direction, and the butting portions may be disposed across the unlocking surface in a width direction intersecting the separating direction of the resilient locking piece and the front stop. Accordingly, no butting portion is present within a formation range of the unlocking surface. Thus, the unlocking surface can be flat and has good operability.

A turning surface may be formed on a rear part of the connection detecting member for turning a forward pressing force applied to the connection detecting member from behind in the unlocking direction. The lock arm may curve and deform if an external force in the inverting direction opposite to the unlocking direction is applied to the support, and may cause the resilient locking piece to separate from the front stop. However, a pressing force is turned in the unlocking direction by the turning surface when a worker presses a rear end part of the connection detecting member forward. Thus, there is no possibility that the support is pressed in the inverting direction. In this way, the curved deformation of the lock arm and the corresponding separation of the resilient locking piece from the front stop can be prevented reliably.

The movement restricting portion may have a stopper surface configured to contact a finger or tool that presses a pressing surface of the connection detecting member at the initial position when the connection detecting member is returned from the detection position to the initial position. For example, when the connection detecting member is small, the connection detecting member may escape rearward without stopping at the initial position if an operation force (pushing force) in returning the connection detecting member from the detection position to the initial position is excessive. However, in the above-described configuration, the finger or tool can contact the stopper surface of the movement restricting portion and the connection detecting member can be stopped reliably at the initial position.

The second housing may include a tubular receptacle into which the first housing can fit. An entrance allowing portion may be provided at an opening of the receptacle facing the connection detecting member when the second housing is connected properly to the first housing and may be recessed away from the pressing surface of the connection detecting member for allowing entrance of the finger or tool. Accordingly, even if the opening of the receptacle faces the connection detecting member when the housings are connected properly, the connection detecting member can be returned from the detection position to the initial position without any trouble by inserting the finger or tool into the entrance allowing portion. Further, the entrance allowing portion can serve as a mark specifying a pressing position when pressing the connection detecting member from the detection position to the initial position.

The pressing surface and the stopper surface may be disposed substantially at the same position in the front-rear direction when the connection detecting member is at the initial position. According to this configuration, the connection detecting member reaches the initial position as the finger or tool contacts both the pressing surface and the stopper surface. Thus, operability is excellent. Further, a state where the connection detecting member is at the initial position after a movement easily can be detected visually.

BRIEF DESCRIPTION OF THE DRAWING

FIG. 18 is a side view in section showing the state where the first and second housings are properly connected and the connection detecting member is at the detection position.

DETAILED DESCRIPTION

Figure 15:
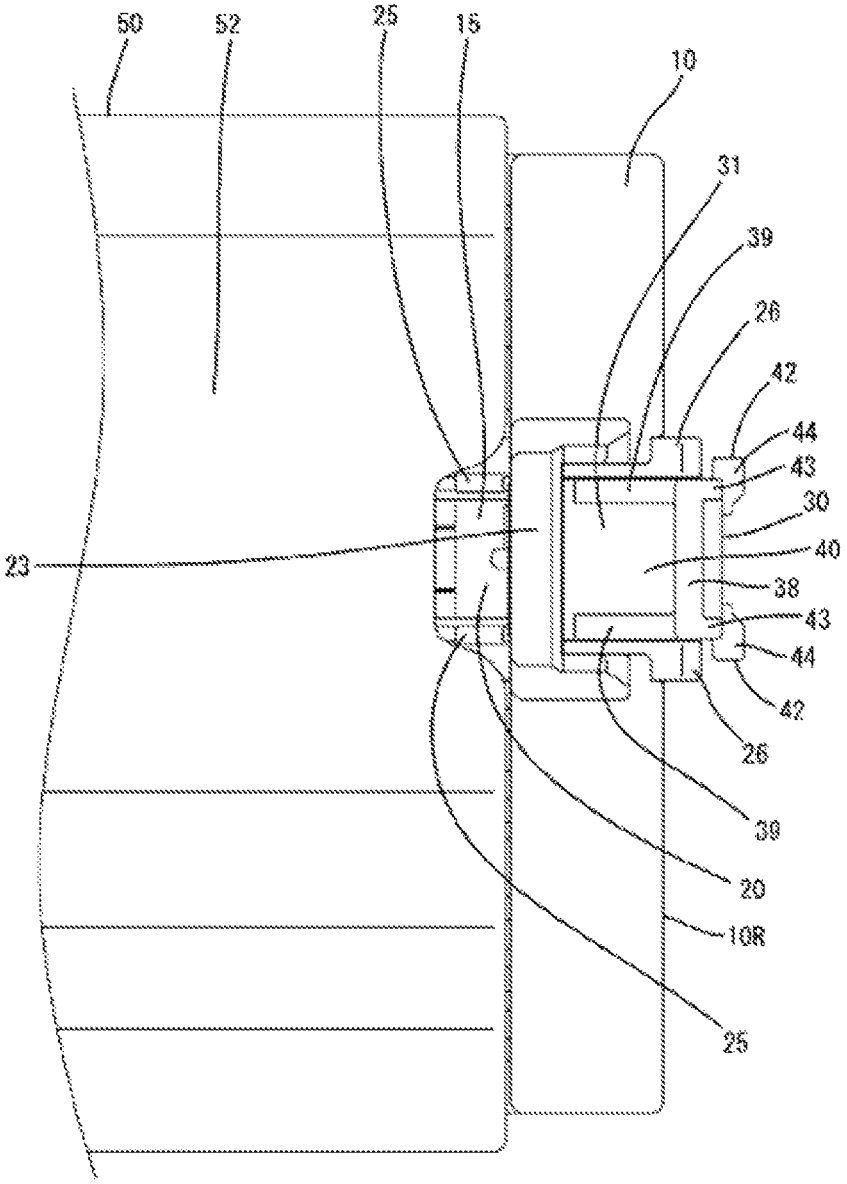
FIG. 15 is a plan view showing a state where the first and second housings are properly connected and the connection detecting member is held at the initial position.

One specific embodiment of the invention is described with reference to FIGS. 1 to 20. Note that, in the following description, a left side in FIGS. 10 to 20 is defined as a front except for a second housing 50 and male terminal fittings 53 to be described later concerning a front-rear direction. Upper and lower sides shown in FIGS. 1 to 4, 6 to 9, 11 to 13, 16 and 18 to 20 are defined as upper and lower sides concerning a vertical direction. An upper side in FIGS. 5, 15 and 17 is defined as a right side concerning a lateral direction.

<Basic Configuration of Connector>

A connector of this embodiment includes a first housing 10 and the second housing 50 connectable to the first housing 10 from the front. The second housing 50 is formed with a lock 54, and the first housing 10 is formed with a lock arm 15 for locking the housings 10, 50 in a properly connected state by locking the lock 54. The lock arm 15 is resiliently displaceable in an unlocking direction to be separated from the lock 54. A support 20 is formed on a rear part of the lock arm 15, and a connection detecting member 30 is mounted on the support 20 to be integrally resiliently displaceable in the unlocking direction. The connection detecting member 30 is relatively movable between an initial position and a detection position forward of the initial position with respect to the support 20.

The lock arm 15 is formed with a front stop 19 disposed at a position forward of the support 20 in the front-rear direction. The connection detecting member 30 is formed with a resilient locking piece 32 projecting forward from a body 31 supported on the support 20. In a state where the housings 10, 50 are not connected or are connected incompletely, the resilient locking piece 32 contacts the front stop 19, thereby restricting a movement of the connection detecting member 30 at the initial position to the detection position. Further, with the housings 10, 50 properly connected, the resilient locking piece 32 is resiliently displaced in a separating direction from the front stop 19 due to interference with the lock 54 so that the connection detecting member 30 is allowed to move to the detection position.

<First Housing 10>

Figure 12:
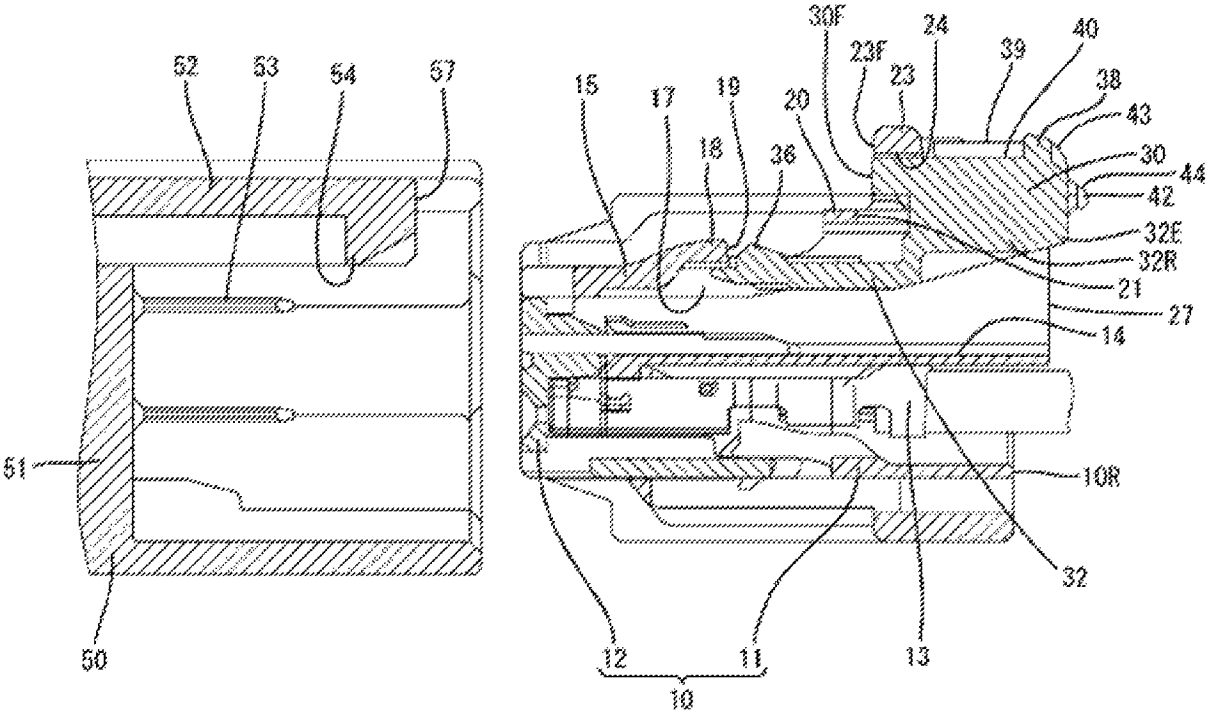
FIG. 12 is a side view in section showing a state before the first housing and a second housing are connected.

The first housing 10 includes a housing body 11 made of synthetic resin and a front retainer 12 made of synthetic resin and assembled with a front end of the housing body 11. As shown in FIG. 12, female terminal fittings 13 are inserted into the housing body 11 from behind. The upper surface of the housing body 11 is recessed from the front end to the rear end thereof, thereby forming an accommodation recess 14.

The lock arm 15 is accommodated in the accommodation recess 14. The lock arm 15 is shaped to be elongated in the front-rear direction and connected to the inner surface of the accommodation recess 14 at a coupling 16 on a front part thereof. That is, the lock arm 15 is cantilevered rearward from the coupling 16. The lock arm 15 is resiliently displaceable in the unlocking direction (down), which is a direction approaching the upper surface of the housing body 11 with the coupling 16 as a fulcrum.

A locking hole 17 vertically penetrates a substantially central part of the lock arm 15 in the front-rear direction. A lock 18 projects up (direction opposite to the unlocking direction) in a region of the upper surface of the lock arm 15 in front of and adjacent to the locking hole 17. A front part of the inner wall surface of the locking hole 17 and a rear part of the lock 18 are connected to be flush with each other, thereby forming the front stop 19. The support 20 on which the connection detecting member 30 is mounted is formed on a rear part (free end) of the lock arm 15. The support 20 is a plate substantially at a right angle to the unlocking direction. A guide groove 21 extends straight forward from the rear end of the support 20 and in a laterally central part of the support 20.

Two side walls 22 rise up from both left and right side edges of the accommodation recess 14 at positions near the rear end of the upper surface of the first housing 10. Both left and right end parts of a movement restricting portion 23 elongated in the lateral direction are connected to the upper ends of the left and right side walls 22. That is, the movement restricting portion 23 is disposed to cross above the accommodation recess 14 in the lateral direction.

The front surface of the movement restricting portion 23 serves as a stopper surface 23F capable of contacting a finger 90 pressing the connection detecting member 30 at the initial position when the connection detecting member 30 is moved in a return direction from the detection position to the initial position. The stopper surface 23F is elongated in the lateral direction and is flat without any step in the lateral direction and vertical direction. A space in front of the stopper surface 23F is left open when the first housing 10 is left unconnected or when the housings 10, 50 are connected properly. The movement restricting portion 23 restricts an inadvertent movement of the connection detecting member 30 to the detection position and restricts inadvertent rearward escape of the connection detecting member 30 from the initial position. A region on the lower surface side of the movement restricting portion 23 functions as an inversion restricting portion 24. That is, the movement restricting portion 23 and the inversion restricting portion 24 are formed integrally. The inversion restricting portion 24 restricts an improper resilient displacement of the lock arm 15 in an inverting direction (upward) opposite to the unlocking direction.

As shown in FIG. 5, the first housing 10 is formed with two bilaterally symmetrical front displacement restricting portions 25. The front displacement restricting portions 25 project laterally in from both left and right inner wall surfaces of the accommodation recess 14. In the front-rear direction, the front displacement restricting portions 25 are disposed at the same position as the front end of the support 20 of the lock arm 15. Two bilaterally symmetrical rear displacement restricting portions 26 are formed on a rear end surface 10R of the first housing 10. The rear displacement restricting portions 26 are ribs projecting rearward from both left and right side edges of an opening end on the rear end of the accommodation recess 14. The front displacement restricting portions 25 and the rear displacement restricting portions 26 restrict a displacement of the connection detecting member 30 at the detection position in the unlocking direction.

Figure 4:
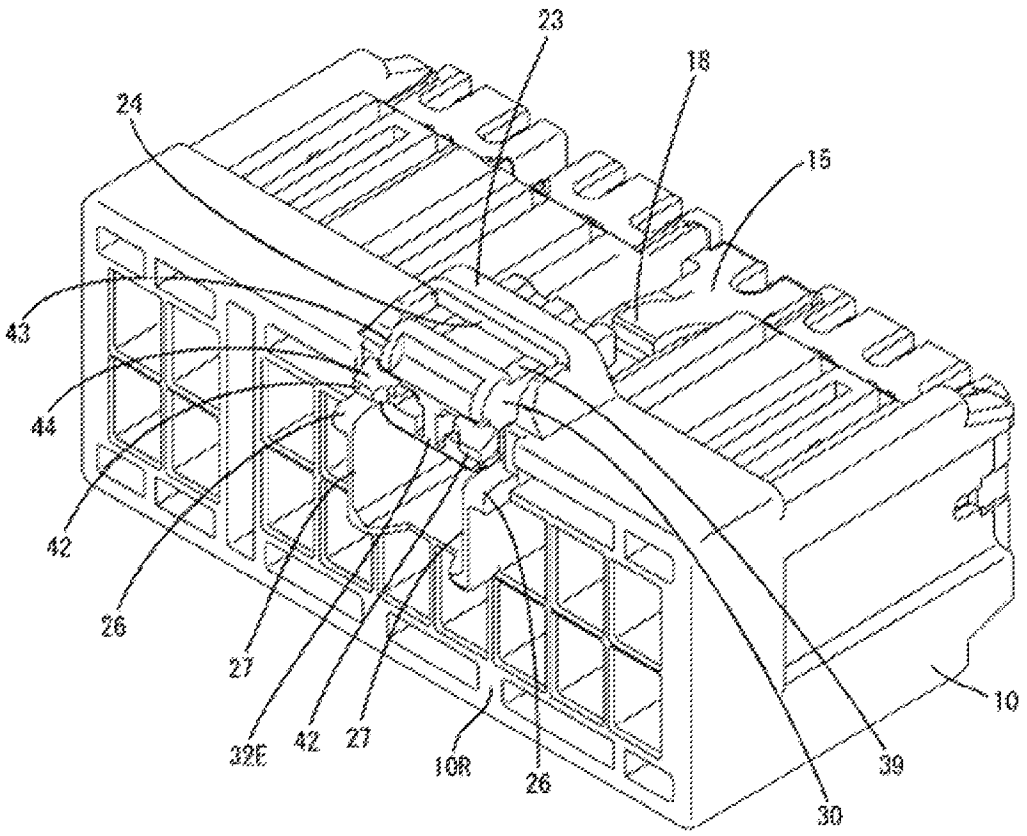
FIG. 4 is a perspective view showing the state where the connection detecting member is held at the detection position in the first housing when obliquely viewed from behind.
Figure 5:
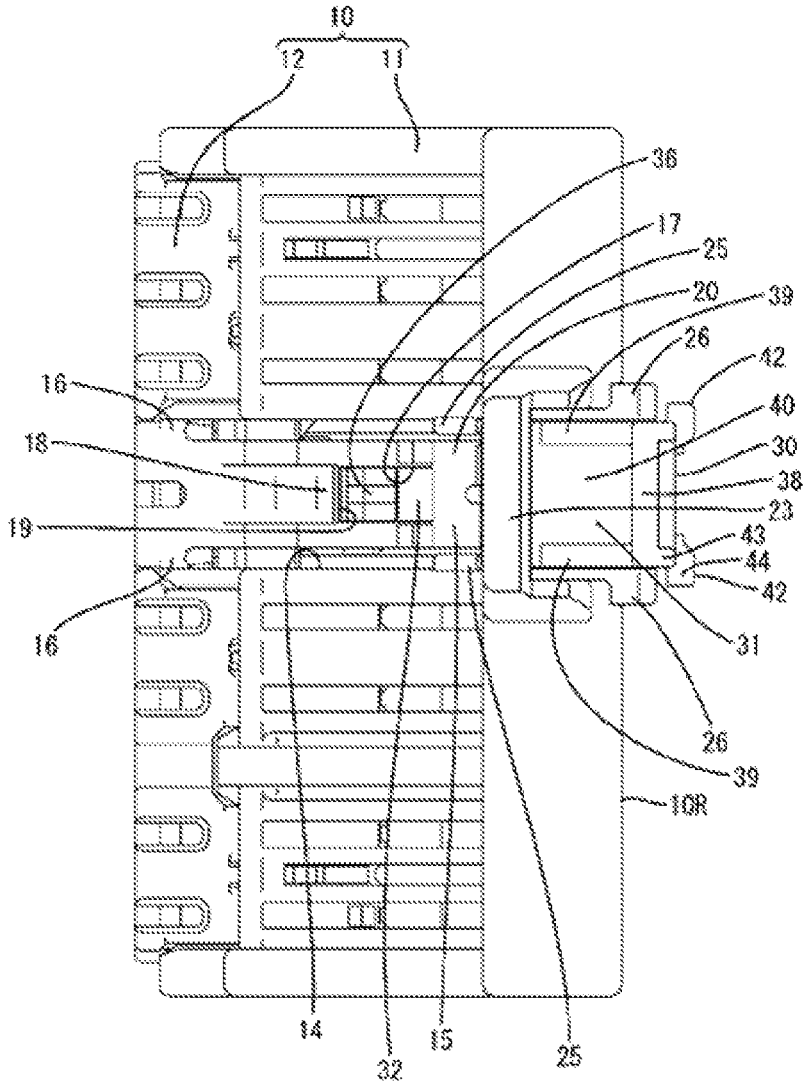
FIG. 5 is a plan view showing the state where the connection detecting member is held at the initial position in the first housing.
Figure 6:
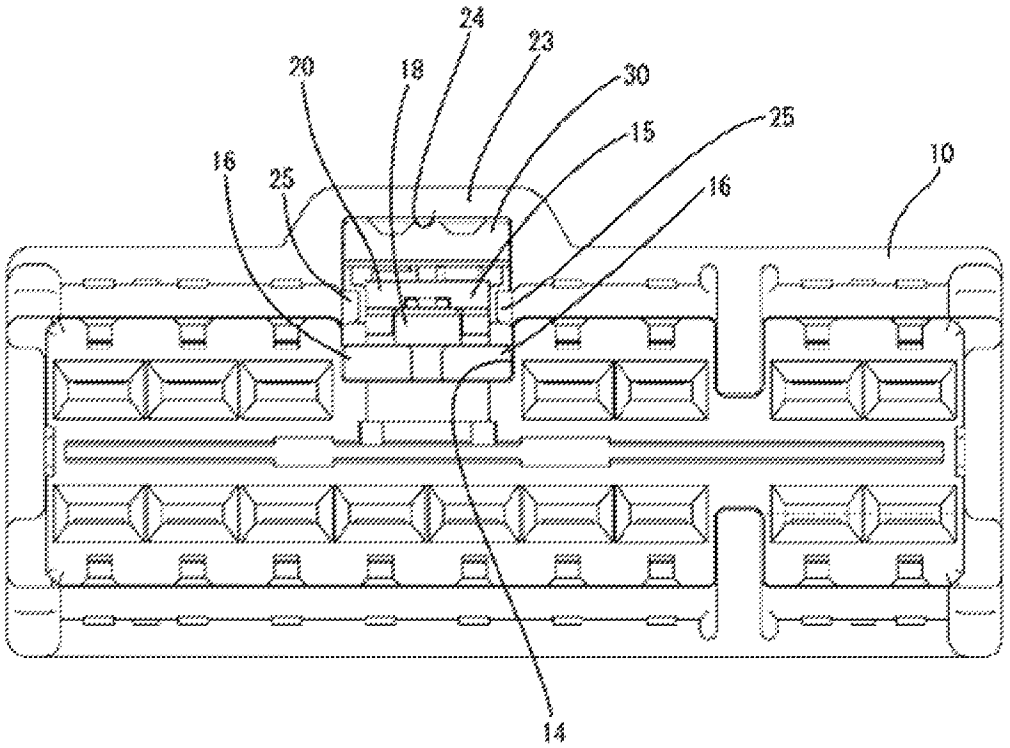
FIG. 6 is a front view of the first housing.
Figure 7:
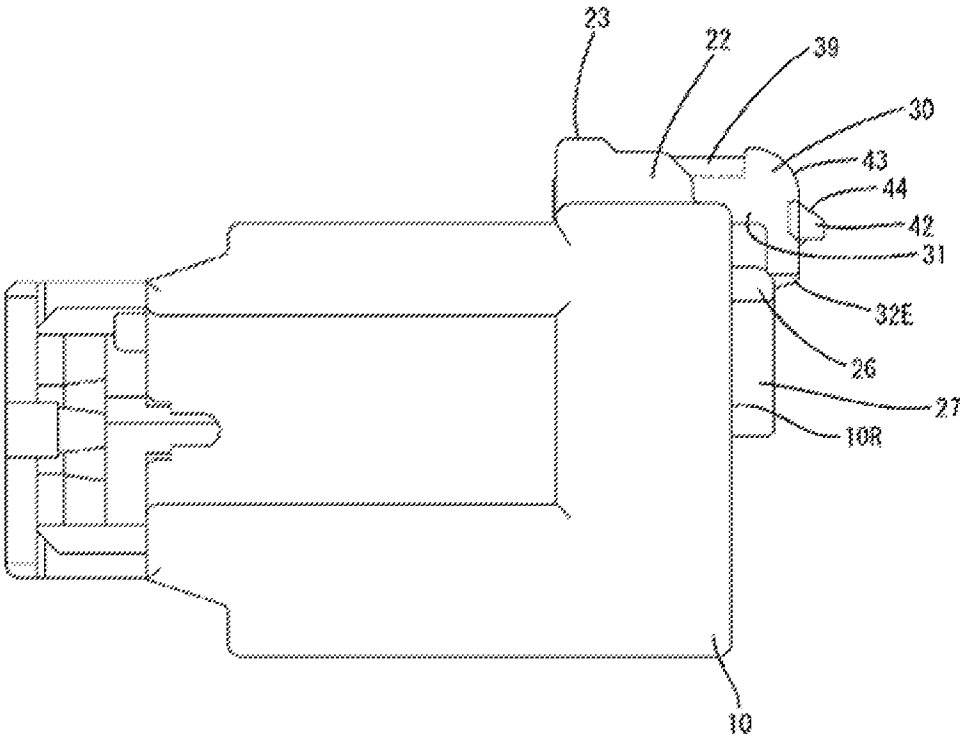
FIG. 7 is a side view showing the state where the connection detecting member is held at the initial position in the first housing.
Figure 8:
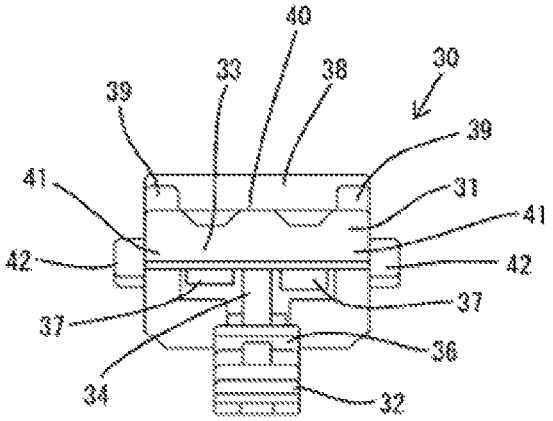
FIG. 8 is a front view of the connection detecting member.
Figure 9:
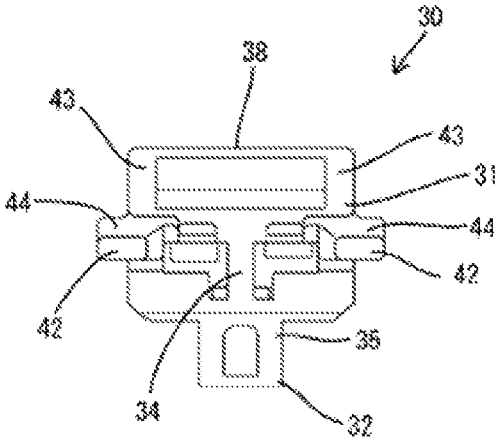
FIG. 9 is a back view of the connection detecting member.
Figure 10:
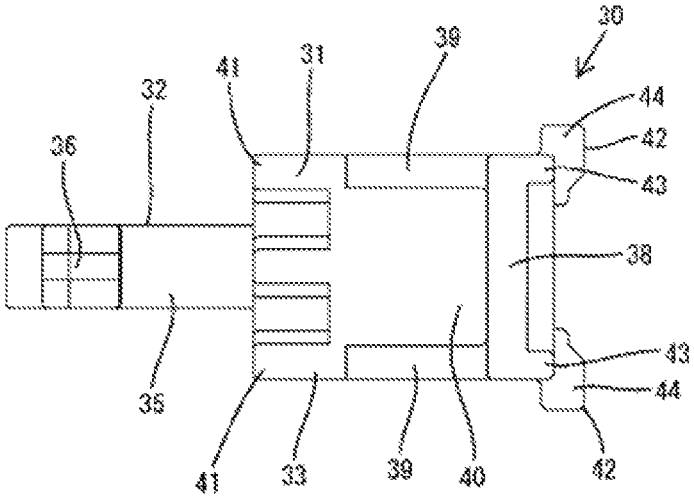
FIG. 10 is a plan view of the connection detecting member.
Figure 11:
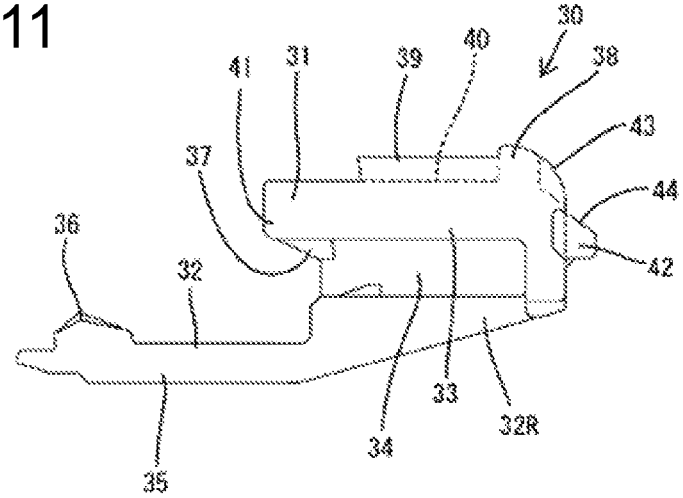
FIG. 11 is a side view of the connection detecting member.

As shown in FIGS. 4 and 7, two bilaterally symmetrical interference restricting portions 27 in the form of ribs project rearward on the rear surface 10R of the first housing 10. The interference restricting portions 27 are disposed along the both left and right sides of the opening edge on the rear end of the accommodation recess 14 and both end parts of the lower edge of the opening on the rear end of the accommodation recess 14. The rear displacement restricting portions 26 protrude laterally out from the upper ends of the left and right interference restricting portions 27. That is, the interference restricting portions 27 and the rear displacement restricting portions 26 are formed integrally. The rear ends of the interference restricting portions 27 and those of the rear displacement restricting portions 26 are disposed at the same position in the front-rear direction.

<Connection Detecting Member 30>

The connection detecting member 30 is a single component made of synthetic resin and including, as shown in FIGS. 8 to 11, the body 31 and the resilient locking piece 32. The body 31 includes a base plate 33 having a substantially rectangular shape in a plan view and a plate-like leg 34 projecting down from the lower surface of the base plate 33. The leg 34 is disposed in a laterally central part of the base plate 33 with a plate thickness direction oriented in the lateral direction.

The resilient locking piece 32 is elongated in the front-rear direction. A rear end part 32R of the resilient locking piece 32 is wider than the leg 34 and is connected to the lower end of the leg 34. Parts of the rear end 32R of the resilient locking piece 32 protrude laterally outward of the leg 34 to face the lower surface of the base plate 33. A region of the resilient locking piece 32 in front of the rear end part 32R serves as an arm 35 cantilevered forward from the body 31. The arm 35 is resiliently displaceable in the vertical direction with respect to the body 31. A pressure receiving projection 36 projects up on a front end part of the arm 35.

The connection detecting member 30 is assembled with the supporting portion 20 of the lock arm 15 from behind. In an assembled state, the base plate 33 and the rear end part 32R vertically sandwich the support 20, thereby restricting a relative displacement and a relative inclination of the body 31 in the vertical direction with respect to the support 20. That is, the support 20 and the body 31 are displaced integrally in the vertical direction in a side view.

With the connection detecting member 30 assembled with the support 20, the leg 34 is fit into the guide groove 21. Thus, the body 31 of the connection detecting member 30 is restricted from relatively moving in the lateral direction with respect to the support 20. However, the leg 34 can move forward and rearward between an initial position (see FIGS.

1, 3, 5, 7, 12, 13, 15 and 16) and a detection position (see FIGS. 2, 4, 17, 18 to 20) forward of the initial position by being guided by the guide groove 21.

With the connection detecting member 30 located at the initial position, the pressure receiving projection 36 of the resilient locking piece 32 enters the locking hole 17 and is positioned to contact or proximately face the front stop 19 from behind, as shown in FIG. 12. When the pressure receiving projection 36 contacts the front stop 19, the connection detecting member 30 is restricted from moving to the detection position (forward). Further, the connection detecting member 30 at the initial position is restricted from moving rearward with respect to the support 20 by locking a retaining projection 37 formed on the lower surface of the base plate 33 to a retaining portion (not shown) of the support 20. In this way, the connection detecting member 30 is held at the initial position.

With the connection detecting member 30 at the initial position, as shown in FIG. 12, a front part of the base plate 33 faces the inversion restricting portion 24 from below with a tiny clearance defined therebetween. Accordingly, if the support 20 of the lock arm 15 and the connection detecting member 30 are going to be displaced in the inverting direction (upward), a front part of the base plate 33 contacts the lower surface of the inversion restricting portion 24 to restrict a displacement of the lock arm 15 in the inverting direction. Further, the front part of the base plate 33 is slightly behind the front end of the support 20 and a rear end of the base plate 33 projects farther rearward than the rear end surface 10R of the first housing 10.

Figure 1:
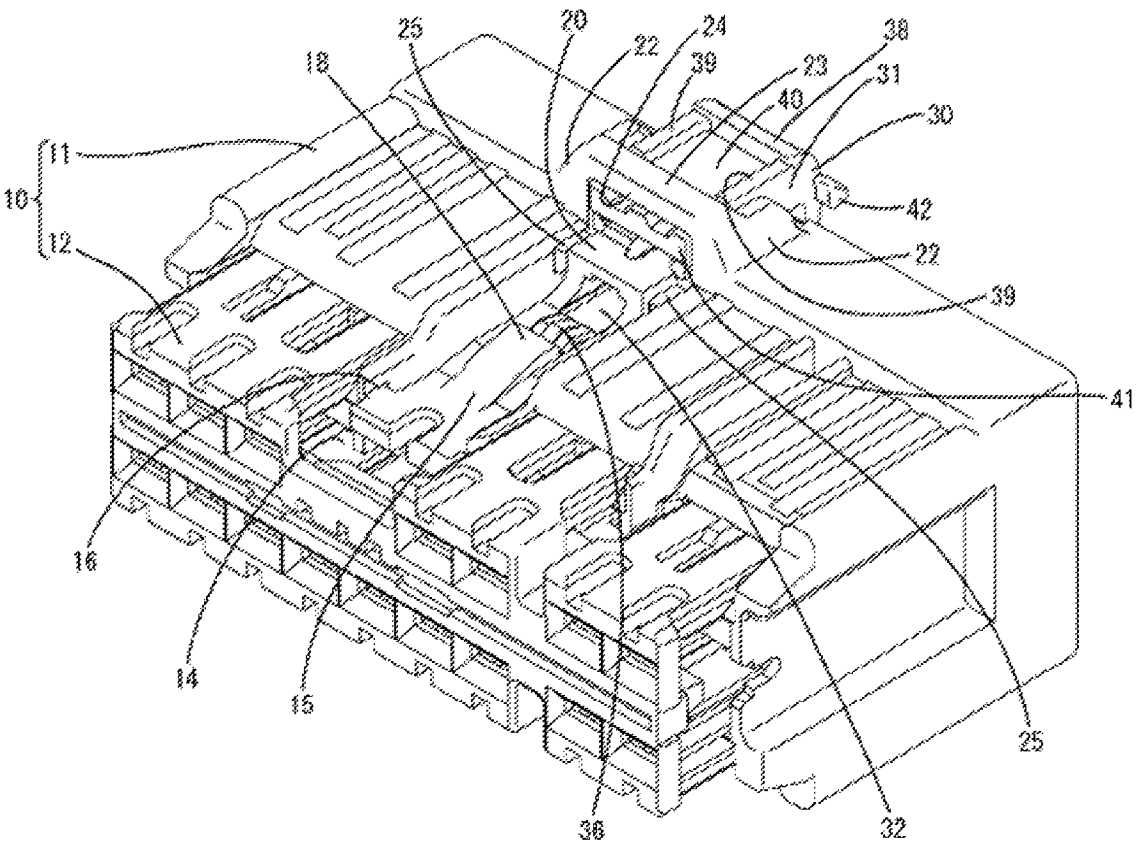
FIG. 1 is a perspective view showing a state where a connection detecting member is held at an initial position in a first housing of an embodiment when obliquely viewed from front.
Figure 2:
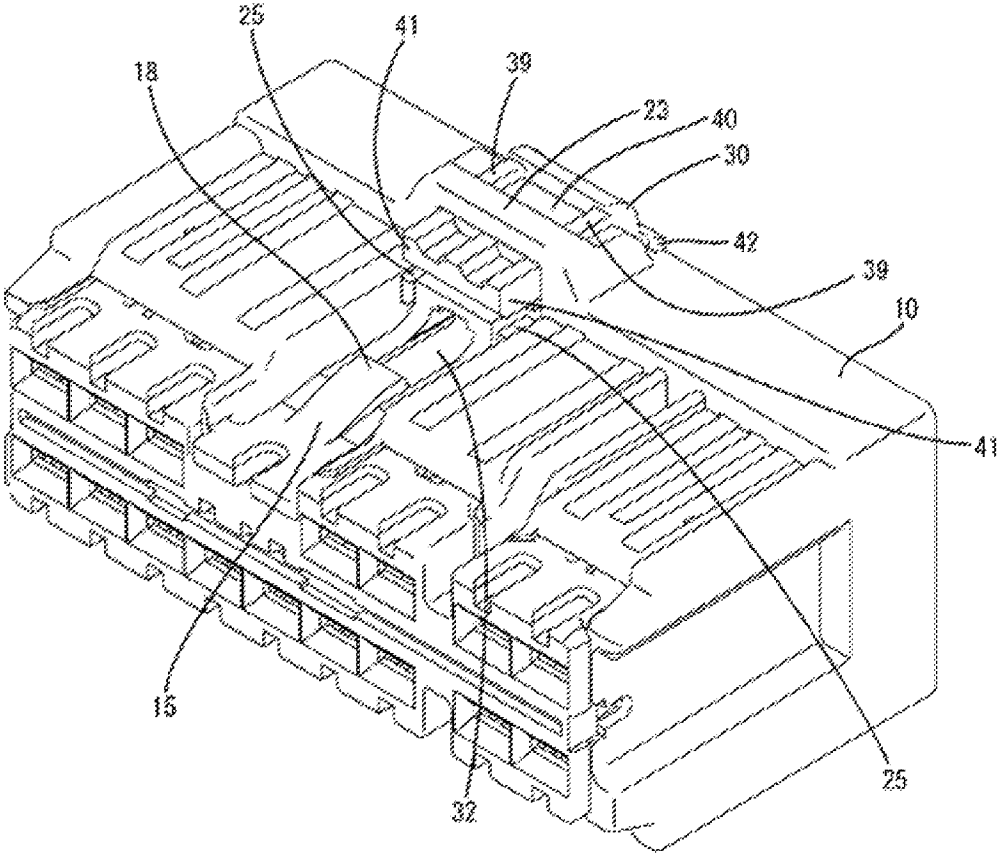
FIG. 2 is a perspective view showing a state where the connection detecting member is held at a detection position in the first housing when obliquely viewed from front.
Figure 3:
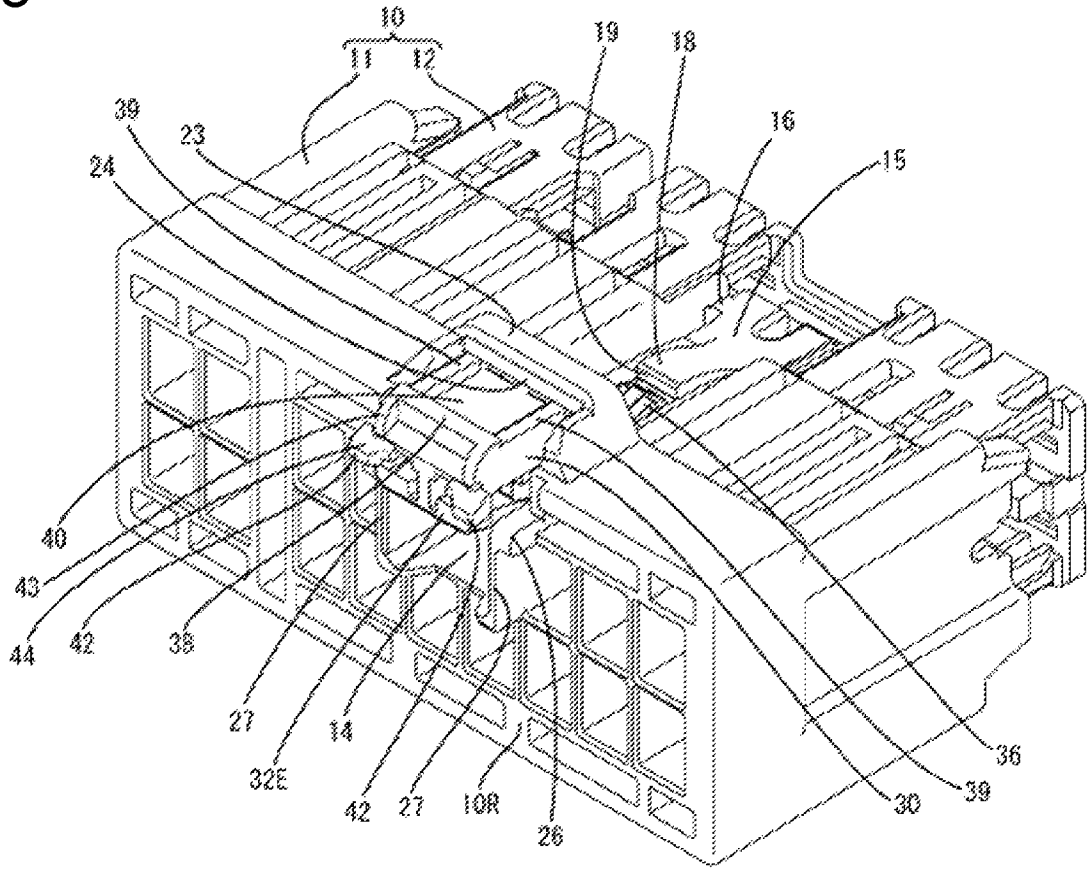
FIG. 3 is a perspective view showing the state where the connection detecting member is held at the initial position in the first housing when obliquely viewed from behind.

As shown in FIGS. 1 and 12, the upper surface of the base plate 33 is formed with a finger hooking portion 38 in the form of a rib projecting in the lateral direction along the rear end of the upper surface of the base plate 33. The upper surface of the base plate 33 is formed with two bilaterally symmetrical butting portions 39 in the form of ribs projecting in the front-rear direction along both left and right side edges of the upper surface of the base plate 33. The rear ends of the butting portions 39 are connected to both left and right ends of the finger hooking portion 38. The front ends of the butting portions 39 are located slightly behind the front end of the base plate 33.

With the connection detecting member 30 located at the initial position, the front ends of the butting portions 39 are slightly behind the rear end of the movement restricting portion 23. Further, in a state where the connection detecting member 30 is at the initial position and the lock arm 15 is not resiliently displaced, a formation range of the butting portions 39 in the vertical direction (resilient displacing direction of the lock arm 15) and a formation range of the movement restricting portion 23 in the vertical direction partially overlap. That is, the front surfaces of the butting portions 39 are facing the rear surface of the movement restricting portion 23 with a tiny clearance defined therebetween.

A substantially rectangular region defined by the finger hooking portion 38 and the left and right butting portions 39 on the upper surface of the base plate 33 serves as an unlocking surface 40. That is, the butting portions 39 are disposed at both sides of the unlocking surface 40 in the lateral direction (width direction). With the connection detecting member 30 located at the initial position, a front end part of the upper surface of the base plate 33 faces the inversion restricting portion 24 of the movement restricting portion 23 and concealed by being covered from above by the movement restricting portion 23, and the unlocking surface 40 is behind the movement restricting portion 23 and exposed to be open upward. Further, at the initial position, the front end (pressing surface 30F to be described later) of the base plate 33 is aligned substantially at the same position as the front end (stopper surface 23F) of the movement restricting portion 23 in the front-rear direction. When the connection detecting member 30 moves to the detection position, the front part of the upper surface of the base plate 33 projects significantly forward from the front end of the movement restricting portion 23 to be visually confirmable, whereas a front part of the unlocking surface 40 is hidden below the movement restricting portion 23 (inversion restricting portion 24). Since the upper surface of the base plate 33 is partially covered and protected by the movement restricting portion 23 regardless of whether the connection detecting member 30 is at the initial position or at the detection position, the interference of external matter with the base plate 33 from above is prevented.

Both left and right ends of the front part of the base plate 33 function as front contacts 41. In the lateral direction, two of the front contacts 41 are at the same position as the two front displacement restricting portions 25. However, with the connection detecting member 30 located at the initial position, the front contacts 41 are behind the front displacement restricting portions 25. Thus, when the lock arm 15 is resiliently displaced in the unlocking direction, the front contacts 41 do not interfere with the front displacement restricting portions 25.

When the connection detecting member 30 moves to the detection position, the two front contacts 41 face the two front displacement restricting portions 25 from above with a tiny clearance defined therebetween. In this state, if the lock arm 15 is going to be displaced resiliently in the unlocking direction, the front contacts 41 contact the two front displacement restricting portions 25 from above, to restrict a displacement of the lock arm 15 in the unlocking direction.

The body 31 of the connection detecting member 30 is formed with left and right rear contacts 42 that project obliquely rearward from both left and right end parts of a rear end of the body 31. The rear contacts 42 protrude farther laterally outward than both left and right sides of the body 31. In the lateral direction, the two rear contacts 42 are at the same position as the two rear displacement restricting portions 26. However, with the connection detecting member 30 located at the initial position, the rear contacts 42 are behind the rear displacement restricting portions 26. Thus, when the lock arm 15 is displaced resiliently in the unlocking direction, the rear contacts 42 do not interfere with the rear displacement restricting portions 26.

When the connection detecting member 30 moves to the detection position, the rear contacts 42 face the rear displacement restricting portions 26 from above with a tiny clearance defined therebetween. In this state, if the lock arm 15 is going to be displaced resiliently in the unlocking direction, the rear contacts 42 contact the two rear displacement restricting portions 26 from above to restrict a displacement of the lock arm 15 in the unlocking direction.

The rear end part of the connection detecting member 30 is formed with left and right upper turning surfaces 43 and left and right lower turning surfaces 44. The upper turning surfaces 43 are disposed on both left and right end parts of a rear end edge part of the base plate 33. The upper turning surfaces 43 have a substantially arcuate shape in a side view. Further, the lower turning surfaces 44 are formed on the upper surfaces of the rear contact portions 42 and are obliquely below and behind the upper turning surfaces 43. Both the upper turning surfaces 43 and the lower turning surfaces 44 are facing an oblique upper-rear side. Thus, if a forward external force is applied to the upper and lower turning surfaces 43, 44 from behind, the forward external force is applied as a downward pressing force to the connection detecting member 30 and the rear end part of the lock arm 15 by the turning surfaces 43, 44. This downward pressing force acts in the same direction as the unlocking direction in the vertical direction.

The front surface of the base plate 33 is formed as the pressing surface 30F to be pressed by a tip (including the tip of a nail) of the finger 90 when the connection detecting member 30 is returned from the detection position to the initial position. The pressing surface 30F is formed to be elongated in the lateral direction and flat substantially without any step along the lateral direction and vertical direction.

<Second Housing 50>

The second housing 50 is made of synthetic resin and includes a terminal holding portion 51 and a receptacle 52 in the form of a rectangular tube projecting forward (rightward in FIG. 12) from the outer peripheral edge of the terminal holding portion 51. Male terminal fittings 53 are held in the terminal holding portion 51, and tabs on the front ends of the male terminal fittings 53 are collectively surrounded by the receptacle 52. An upper wall of the receptacle 52 is formed with the lock 54. The lock 54 projects down (inward of the receptacle 52) from the front end of the upper wall. This projecting direction of the lock 54 is the same as the unlocking direction of the lock arm 15 in the vertical direction. The first housing 10 is fit into the receptacle 52. When the first housing 10 is fit properly into the receptacle 52, the housings 10, 50 are connected properly and the female terminal fittings 13 and the male terminal fittings 53 are connected.

An entrance allowing portion 57 for allowing the entrance of the finger 90 with the housings 10, 50 properly connected is provided at an opening edge of the receptacle 52. The entrance allowing portion 57 faces the pressing surface 30F of the connection detecting member 30 in the front-rear direction when the housings 10 50 are connected properly, and is recessed in a direction away from the pressing surface 30F into a substantially U shape in a plan view. The tip of the finger 90 of a worker enters the entrance allowing portion 57, and contacts the pressing surface 30F of the connection detecting member 30 at the detection position and further presses the pressing surface 30F in moving the connection detecting member 30 to the initial position.

<Functions and Effects in State where Both Housing 10, 50 are not Connected>

In the state where the housings 10, 50 are not connected, the rear end part of the body 31 of the connection detecting member 30 held at the initial position projects farther rearward than the interference restricting portions 27. Thus, if external matter, such as a wire, is caught by the lower surface of the rear end part of the body 31, the lock arm 15 and the connection detecting member 30 may be displaced in the inverting direction (upward). However, since the inversion restricting portion 24 is arranged to face the front of the body 31 from above with a tiny clearance defined therebetween, the lock arm 15 and the connection detecting member 30 are not displaced in the inverting direction.

Further, if the rear end part (region behind the inversion restricting portion 24) of the body 31 is pressed in the inverting direction with a large force with the front of the body 31 held in contact with the inversion restricting portion 24, the lock arm 15 may be curved to bulge down (unlocking direction). If the lock arm 15 is curved, the support 20 on the rear of the lock arm 15 is inclined forward. Thus, the body 31 supported on the support 20 also is inclined forward integrally with the support 20. If the body 31 is inclined forward, the front part (pressure receiving projection 36) of the resilient locking piece 32 extending forward from the body 31 is displaced downward so that a locking margin (contact region) between the pressure receiving projection 36 and the front stop 19 in the vertical direction becomes smaller or the pressure receiving projection 36 is separated from the front stop 19.

If the locking margin between the pressure receiving projection 36 and the front stop 19 becomes smaller or the pressure receiving projection 36 is separated from the front stop 19, the connection detecting member 30 may be pushed to the detection position without being held at the initial position when a pressing force is applied to the connection detecting member 30 from behind. If the housings 10, 50 are connected with the connection detecting member 30 pushed to the detection position, the connected state of the housings 10, 50 cannot be detected precisely. However, even if the connection detecting member 30 is pushed forward with the lock arm 15 curved, as described above, the butting portions 39 of the connection detecting member 30 butt against the movement restricting portion 23 of the first housing 10 from behind to prevent a movement of the connection detecting member 30 toward the detection position.

Further, if the worker tries to push the connection detecting member 30 at the initial position to the detection position by erroneously pushing the body 31 from behind in the state where the housings 10, 50 are not connected, an upward (inverting direction opposite to the unlocking direction) force is applied to the support 20 and the lock arm 15 may be curved and deformed as described above. However, since the finger 90 of the worker is in contact with the upper turning surfaces 43 and the lower turning surfaces 44 when pushing the body 31, a forward pushing force applied to the body 31 is turned to act downward (unlocking direction) by the inclination of the turning surfaces 43, 44. Thus, there is no possibility that the body 31 and the support 20 of the lock arm 15 are pressed in the inverting direction (upward). Since the curved deformation of the lock arm 15 is prevented in this way, there is no possibility that the resilient locking piece 32 is separated from the front stop 19.

As described above, the first housing 10 is formed with the movement restricting portion 23 in the connector of this embodiment. Even if the lock arm 15 is curved and deformed due to the interference of an external matter or the like and the resilient locking piece 32 is displaced in the separating direction from the front stop 19 due to this curved deformation with the connection detecting member 30 held at the initial position, the butting portions 39 of the connection detecting member 30 contact the movement restricting portion 23 to restrict a movement of the connection detecting member 30 toward the detection position so that the connection detecting member 30 is held at the initial position. Therefore, a connection detecting function by the connection detecting member 30 is excellent in reliability.

Further, the movement restricting portion 23 is formed with the inversion restricting portion 24 for restricting a displacement of the lock arm 15 in the inverting direction opposite to the unlocking direction. According to this configuration, the shape of the first housing 10 can be simplified as compared to the case where a dedicated inversion restricting portion 24 is formed at a location different from the movement restricting portion 23.

Further, the connection detecting member 30 is made of synthetic resin, and improper deformation called a sink may be formed at the time of molding. If a sink is formed to a large extent, the butting portions 39 cannot properly butt against the movement restricting portion 23 when the lock arm 15 is curved and deformed, and the connection detecting member 30 may be pushed to the detection position. However, the butting portions 39 are not in the form of blocks, but in the form of projecting ribs, and are divided and arranged at a plurality of positions. In this way, a sink will not form when molding the connection detecting member 30.

Further, the unlocking surface 40 for unlocking the lock arm 15 from the lock 54 by resiliently displacing the lock arm 15 in the unlocking direction is formed on the outer surface of the connection detecting member 30. The two butting portions 39 are disposed across the unlocking surface 40 in the width direction (lateral direction) intersecting the separating direction of the resilient locking piece 32 and the front stop 19. According to this configuration, since the butting portions 39 are not present in a formation range of the unlocking surface 40, the unlocking surface 40 is flat and has good operability.

Further, as shown in FIGS. 7 and 12, a rearmost end edge part 32E of the rear end part 32R of the resilient locking piece 32 and the rear contacts 42 project farther rearward than the rear end surface 10R (surface in which the rear ends of terminal accommodation chambers are open) of the first housing 10 (housing body 11) with the connection detecting member 30 held at the initial position 30. If external matter interferes with the lower surface of the rearmost end edge part 32E of the resilient locking piece 32 or the lower surface of the rear contact 42, an external force is applied to the support 20 of the lock arm 15 in the inverting direction and the lock arm 15 may be curved and deformed and the resilient locking piece 32 may be separated from the lock arm 15. However, the left and right interference restricting portions 27 arranged below the rear contact portions 42 are at the positions corresponding to the rear contacts 42 in the lateral direction on the rear end surface 10R of the first housing 10. The interference restricting portions 27 are in the form of vertical ribs projecting from the rear end surface 10R of the first housing 10. Due to the presence of these interference restricting portions 27, external matter hardly interferes with the lower surface of the rearmost end edge part 32E of the resilient locking piece 32 and the lower surfaces of the rear contact portions 42.

<Description of Connecting Process of Both Housings 10, 50>

Figure 13:
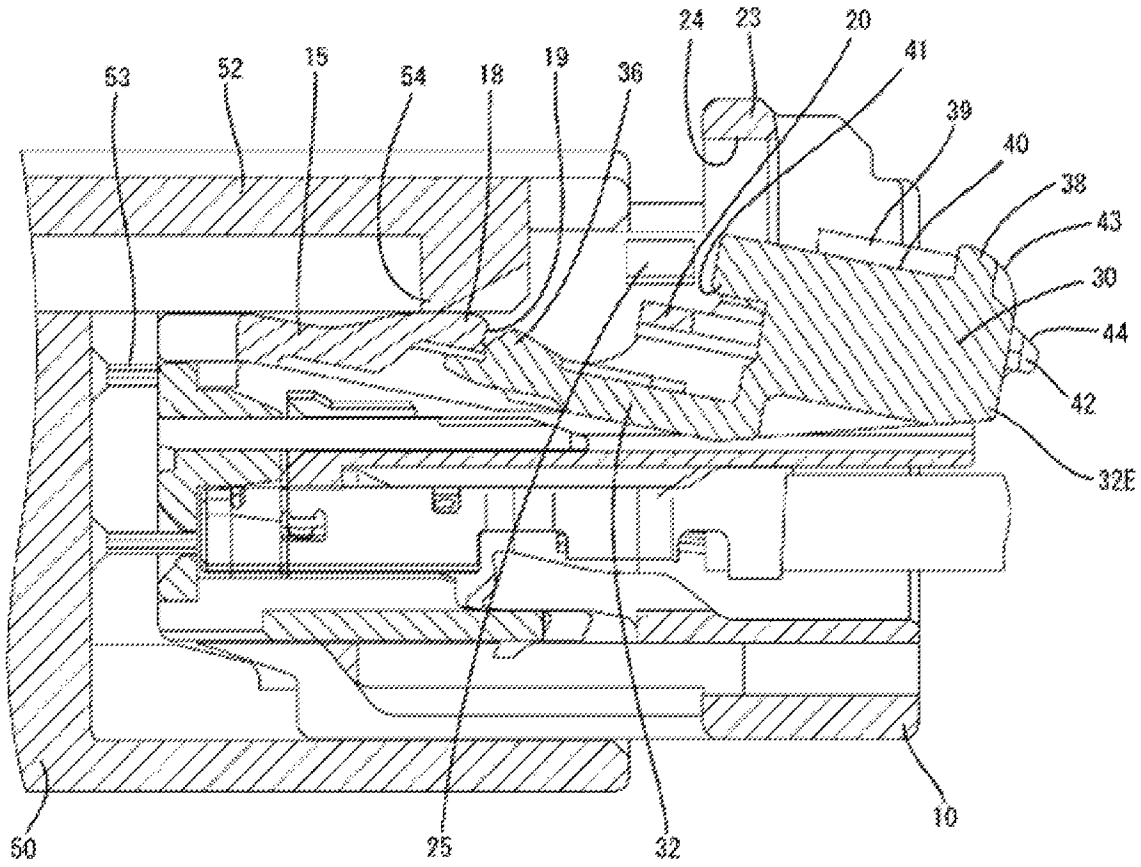
FIG. 13 is a side view in section showing a state where the first and second housings are incompletely connected.
Figure 14:
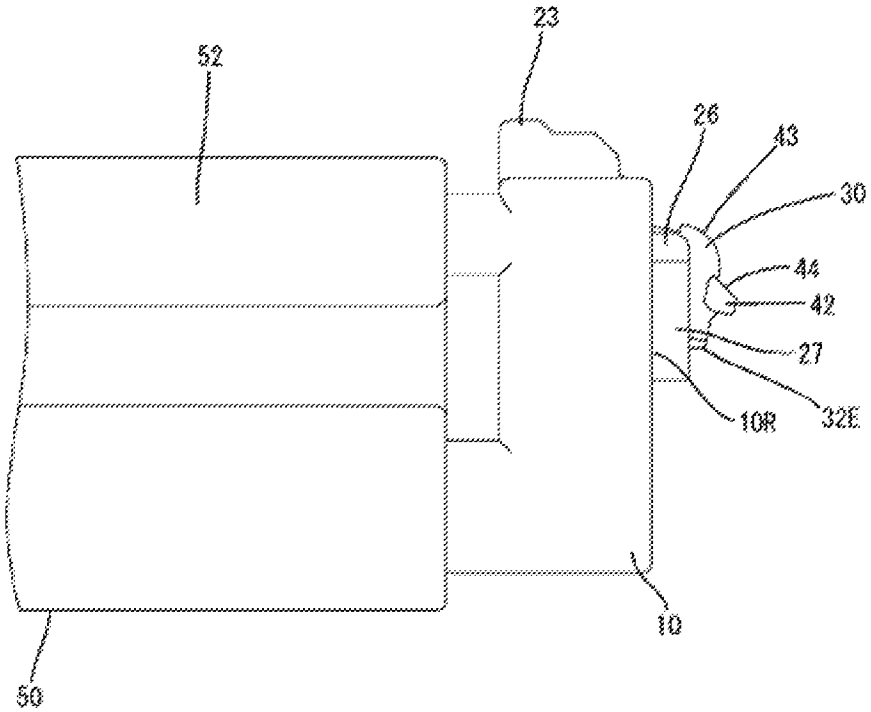
FIG. 14 is a side view showing the state where the first and second housings are incompletely connected.

In connecting the housings 10, 50, the first housing 10 is fit into the receptacle 52 of the second housing 50. In a connecting process, the lock projection 18 interferes with the lock portion 54, the lock arm 15 is displaced resiliently in the unlocking direction and the housings 10, 50 are connected incompletely, as shown in FIG. 13. At this time, the body 31 (connection detecting member 30) mounted on the support 20 of the lock arm 15 is displaced integrally with the support 20 and the resilient locking piece 32 is not in contact with the lock 54. Thus, there is no possibility that the resilient locking piece 32 is separated from the front stop 19. Therefore, even if the connection detecting member 30 is pushed forward in this incompletely connected state, the connection detecting member 30 does not move toward the detection position and is held at the initial position.

Further, when the connection detecting member 30 is displaced integrally with the lock arm 15, the front contacts 41 are displaced down without interfering with the front displacement restricting portions 25 since the front contacts 41 are located behind the front displacement restricting portions 25. Similarly, the rear contacts 42 are located behind the rear displacement restricting portions 26. Thus, the rear contacts 42 also are displaced down without interfering with the rear displacement restricting portions 26. Therefore, an operation of resiliently displacing the lock arm 15 in the unlocking direction is not hindered.

Figure 16:
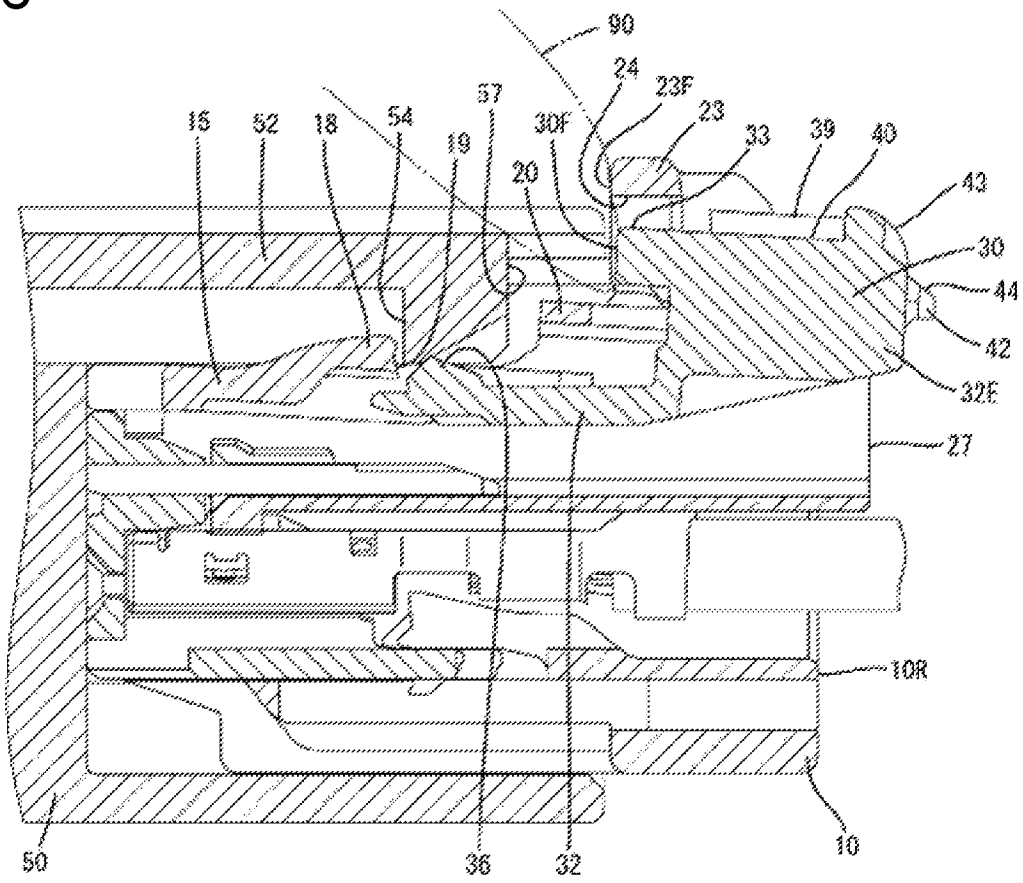
FIG. 16 is a side view in section showing the state where the first and second housings are properly connected and the connection detecting member is held at the initial position.
Figure 17:
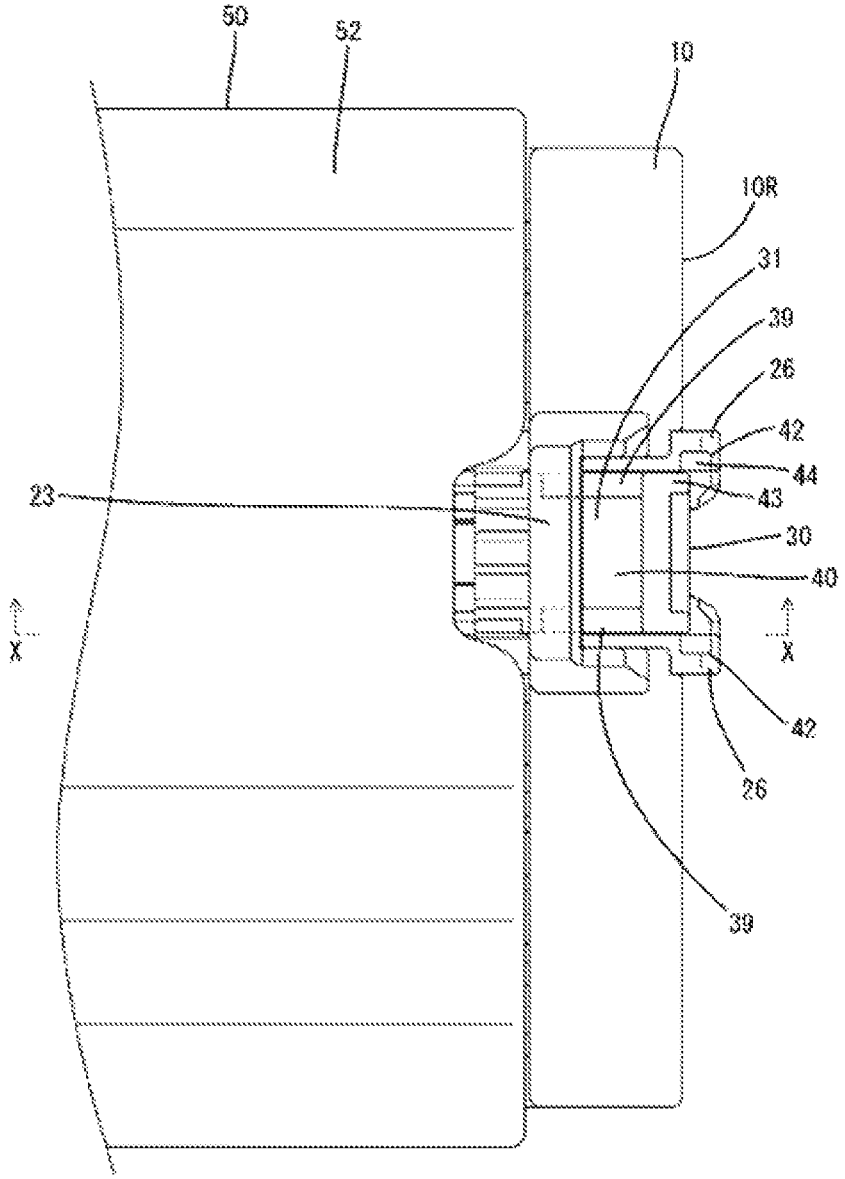
FIG. 17 is a plan view showing a state where the first and second housings are properly connected and the connection detecting member is at the detection position.
Figure 1E:
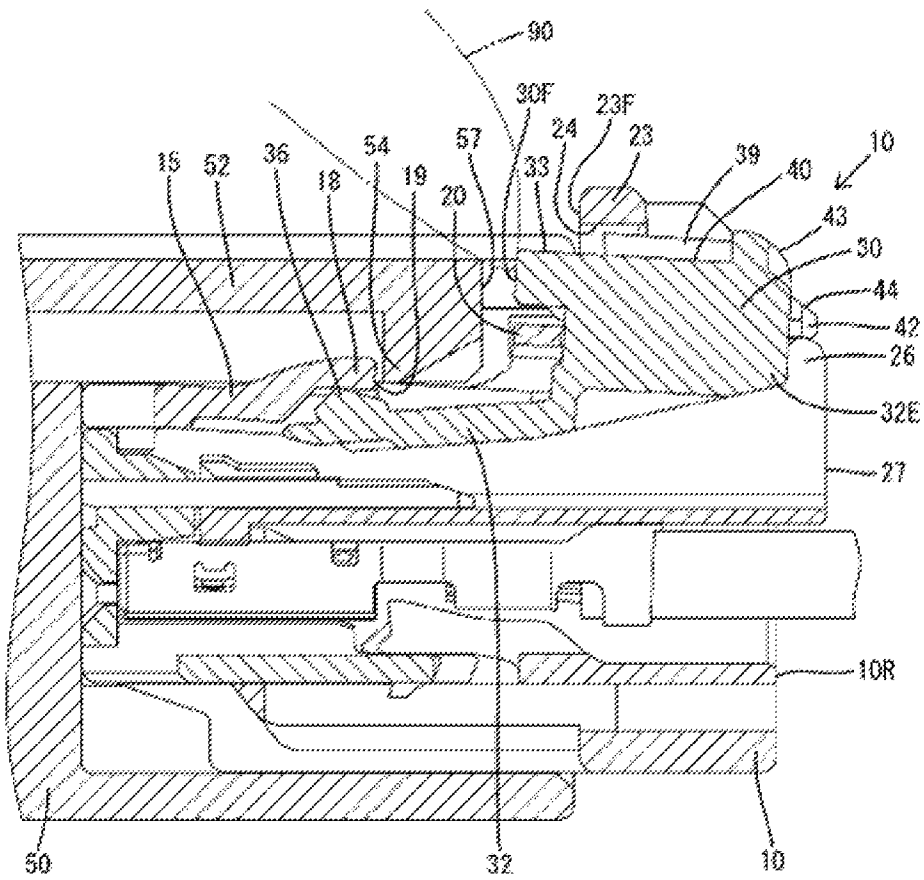

When the housings 10, 50 reach a properly connected state, the lock projection 18 passes through the lock 54, as shown in FIG. 16, and the lock arm 15 resiliently returns upward. When the lock arm 15 resiliently returns, the lock projection 18 and the lock 54 are locked to hold the housings 10, 50 in the properly connected state with the separation thereof restricted.

Further, when the housings 10, 50 reach a properly connected state, the pressure receiving projection 36 of the resilient locking piece 32 is located right below the lock 54. Thus, the pressure receiving projection 36 interferes with the lock 54 and the arm 35 of the resilient locking piece 32 is displaced resiliently down with respect to the lock arm 15 as the lock arm 15 resiliently returns. By this resilient displacement of the arm 35, the pressure receiving projection 36 is separated down with respect to the front stop 19 of the lock arm 15, and the connection detecting member 30 is allowed to move toward the detection position.

Thereafter, if the connection detecting member 30 at the initial position is pushed to the detection position, the connecting operation of the housings 10, 50 is completed. If the housings 10, 50 are left incompletely connected, the pressure receiving projection 36 and the front stop 19 are kept locked as described above. Thus, the connection detecting member 30 cannot be pushed to the detection position. Therefore, the connected state of the housings 10, 50 can be detected based on whether or not the connection detecting member 30 can be moved to the detection position.

<Functions and Effects in State where Both Housings 10, 50 are Properly Connected and Connection Detecting Member 30 is at Detection Position>

Figure 19:
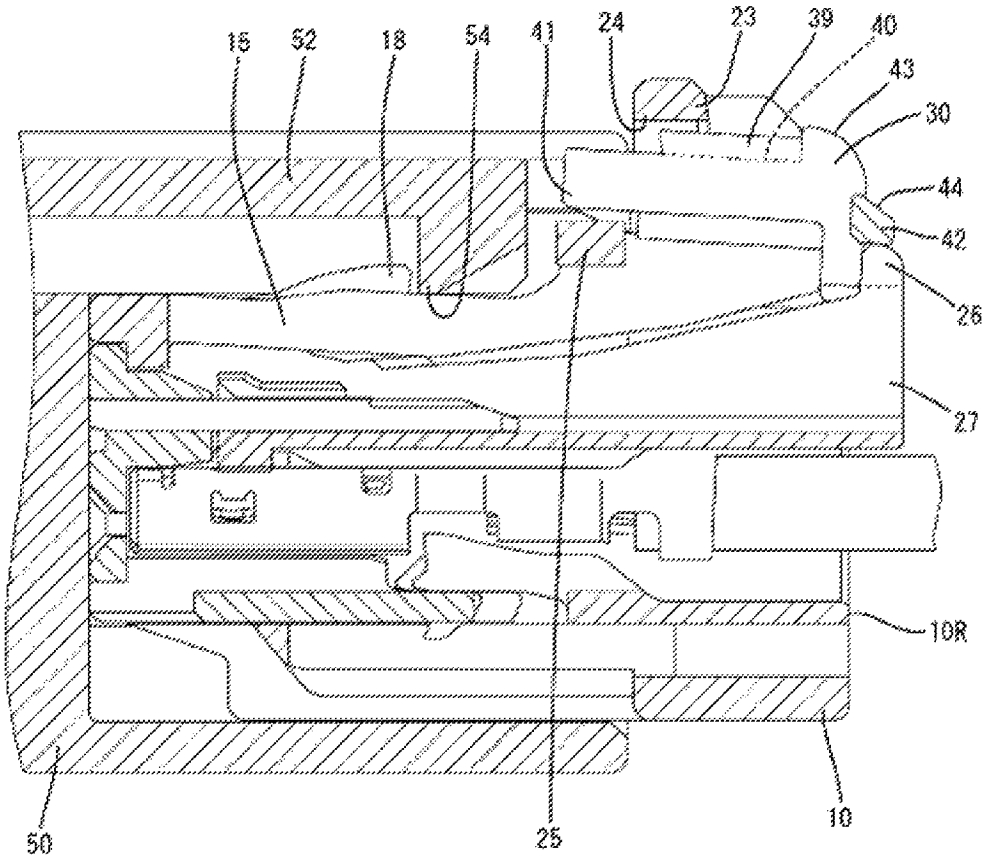
FIG. 19 is a section along X-X of FIG. 17.
Figure 20:
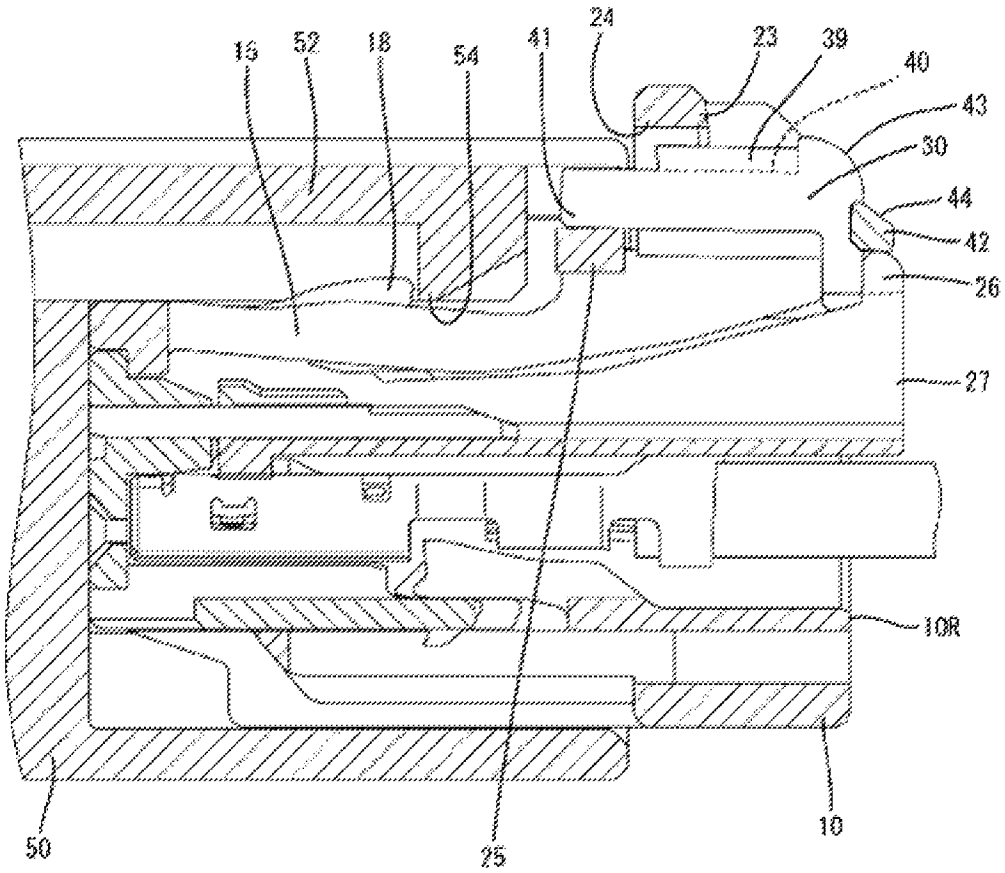
FIG. 20 is a side view in section along X-X of FIG. 17 showing a state where the first and second housings are properly connected, the connection detecting member is held at the detection position and a displacement of a lock arm in an unlocking direction is restricted.

In a state where the housings 10, 50 are connected properly and the connection detecting member 30 is pushed to the detection position, the front end part (pressure receiving projection 36) of the resilient locking piece 32 slips under the lock 18 of the lock arm 15, as shown in FIG. 18. Further, as shown in FIG. 19, the left and right front contact portions 41 face the upper surfaces of the left and right front displacement restricting portions 25 with a tiny clearance defined therebetween and the left and right rear contact portions 42 face the upper surfaces of the left and right rear displacement restricting portions 26 with a tiny clearance defined therebetween or in contact with the upper surfaces of the left and right rear displacement restricting portions 26.

Accordingly, even if a downward (unlocking direction) external force or pressing force is applied to the rear end of the lock arm 15 in this state, the front contacts 41 contact the front displacement restricting portions 25 and the rear contact portions 42 contact the rear displacement restricting portions 26 to restrict a resilient displacement of the lock arm 15 in the unlocking direction. Since the locked state of the lock projection 18 and the lock portion 54 is maintained in this way, the housings 10, 50 are held reliably in the properly connected state. Further, since the front contacts 41, the front displacement restricting portions 25, the rear contacts 42 and the rear displacement restricting portions 26 all are provided as pairs spaced apart in the lateral direction, the lock arm 15 is inclined neither to right nor left. Note that, with the connection detecting member 30 held at the detection position, the front part of the base plate 33 projects farther forward than the front end of the movement restricting portion 23 and that projecting state can be confirmed visually from above.

As described above, the first housing 10 is formed with the front displacement restricting portions 25 and the rear displacement restricting portions 26 in the connector of this embodiment. The front displacement restricting portions 25 restrict a displacement of the lock arm 15 in the unlocking direction by contact with the connection detecting member 30 at the detection position. The rear displacement restricting portions 26 are formed at the positions rearward of the front displacement restricting portions 25 and restrict a displacement of the lock arm 15 in the unlocking direction by contact with the connection detecting member 30 at the detection position.

As just described, the connection detecting member 30 at the detection position restricts displacement of the lock arm 15 in the unlocking direction by contacting the first housing 10, and is in contact with the two types of the displacement restricting portions 25, 26 spaced apart in the front-rear direction. The orientation of the connection detecting member 30 with respect to the first housing 10 is stabilized in a proper manner by this contact at two positions. Thus, the lock arm 15 is not displaced in the unlocking direction. Since the locked state of the lock projection 18 of the lock arm 15 and the lock 54 is maintained reliably in this way, the reliability of a locking function by the lock arm 15 is high.

Further, the connection detecting member 30 is formed with the unlocking surface 40 for resiliently displacing the lock arm 15 and the connection detecting member 30 in the unlocking direction. The front contacts 41 contact the front displacement restricting portions 25 on the connection detecting member 30 and are forward of the unlocking surface 40. Further, the rear contacts 42 contact the rear displacement restricting portions 26 on the connection detecting member 30 and are disposed rearward of the unlocking surface 40. As just described, the front contacts 41 and the rear contacts 42 are arranged while being sufficiently spaced apart in the front-rear direction.

Further, the left and right rear displacement restricting portions 26 are integral to upper end parts of the interference restricting portions 27. Therefore, the rear end part of the first housing 10 is simplified in shape as compared to the case where the interference restricting portions 27 and the rear displacement restricting portions 26 are at different locations.

<Description of Separating Operation of Both Housings 10, 50>

In separating the housings 10, 50, the tip of the finger 90 is inserted into the entrance allowing portion 57, as shown in FIG. 18, and, in that state, the pressing surface 30F is pressed to move the connection detecting member 30 rearward toward the initial position. When the connection detecting member 30 reaches the initial position, the pressing surface 30F and the stopper surface 23F of the movement restricting portion 23 are at substantially the same position in the front-rear direction, the tip of the finger 90 is in contact with the stopper surface 23F of the movement restricting portion 23 in addition to the pressing surface 30F, and a rearward movement of the connection detecting member 30 is stopped, as shown in FIG. 16. Accordingly, even if the worker's pushing force to move the connection detecting member 30 to the initial position increases although the connection detecting member 30 is small in size, the connection detecting member 30 can be stopped reliably at the initial position and the connection detecting member 30 can be prevented from inadvertently escaping rearward by the contact of the tip of the finger 90 with the movement restricting portion 23. Note that the connection detecting member 30 at the initial position can be detected by visually confirming the state where the pressing surface 30F of the connection detecting member 30 and the stopper surface 23F of the movement restricting portion 23 are disposed substantially at the same position in the front-rear direction.

When the connection detecting member 30 reaches the initial position, the front contacts 41 move to positions deviated rearward from the front displacement restricting portions 25 and the rear contacts 42 move to positions deviated rearward from the rear displacement restricting portions 26. Thus, the lock arm 15 is allowed to be displaced in the unlocking direction. If the unlocking surface 40 is pressed in this state, the lock arm 15 is displaced resiliently in the unlocking direction, the lock projection 18 is separated from the lock 54 and the housings 10, 50 are released from the locked state by the lock arm 15. Thereafter, the housings 10, 50 may be pulled apart with the lock arm 15 kept displaced in the unlocking direction.

OTHER EMBODIMENTS

The invention is not limited to the above described and illustrated embodiment. For example, the following embodiments also are included in the scope of the invention.

Although the movement restricting portion is formed with the inversion restricting portion in the above embodiment, a dedicated inversion restricting portion may be formed at a location different from the movement restricting portion.

Two butting portions are formed in the above embodiment, but three or more butting portions may be formed.

A part of the connection detecting member to be brought into contact with the movement restricting portion is divided into a plurality of the butting portions in the form of projecting ribs in the above embodiment. However, the part to be brought into contact with the movement restricting portion may be a single block.

Although the butting portions are disposed across the unlocking surface in the width direction in the above embodiment, the butting portions may be disposed at least partially within the formation region range of the unlocking surface.

Although the turning surfaces are formed on the rear end of the connection detecting member in the above embodiment, the connection detecting member may be formed with no turning surface.

Although the movement restricting portion and the two side walls constitute a U-shape in the above embodiment, two movement restricting portions may project inward from the both side walls to face each other.

Although pressing means for pressing the connection detecting member in moving the connection detecting member from the detection position to the initial position is constituted by the finger of the worker in the above embodiment, the pressing means may be a rod-like or pin-like tool.

LIST OF REFERENCE SIGNS

10 . . . first housing
15 . . . lock arm
19 . . . front stop
20 . . . support
23 . . . movement restricting portion
23F . . . stopper surface
24 . . . inversion restricting portion
30 . . . connection detecting member
30F . . . pressing surface
31 . . . body
32 . . . resilient locking piece

39 . . . butting portion
40 . . . unlocking surface
43 . . . upper turning surface (turning surface)
44 . . . lower turning surface (turning surface)
50 . . . second housing
54 . . . lock
57 . . . entrance allowing portion
90 . . . finger

The invention claimed is:

1. A connector, comprising:

a first housing;

a second housing connectable to a front of the first housing;

a lock formed in the second housing;

a lock arm formed on the first housing, the lock arm locking the first housing and the second housing in a properly connected state by locking the lock, the lock arm being resiliently displaceable in an unlocking direction to be separated from the lock;

a support formed on a rear end part of the lock arm;

a connection detecting member mounted on the support to be integrally resiliently displaceable in the unlocking direction, the connection detecting member being movable with respect to the support between an initial position and a detection position forward of the initial position;

a front stop formed on the lock arm, the front stop being disposed at a position forward of the support in a front-rear direction;

a resilient locking piece projecting forward from a body of the connection detecting member supported on the support, the resilient locking piece being configured to restrict a movement of the connection detecting member at the initial position to the detection position by coming into contact with the front stop portion in a state where the first housing and the second housing are not connected or are connected incompletely and allowing the movement of the connection detecting member to the detection position by being displaced resiliently in a separating direction from the front stop due to interference with the lock in a state where the first housing and the second housing are connected properly; and a movement restricting portion formed on the first housing, the movement restricting portion restricting a movement of the connection detecting member toward the detection position by contact with the connection detecting member when the resilient locking piece is displaced in the separating direction from the front stop due to curved deformation of the lock arm, wherein:

the connection detecting member is made of synthetic resin, and the connection detecting member is formed with butting portions in the form of projecting ribs disposed and configured for contacting the movement restricting portion.

2. The connector of claim 1, comprising an inversion restricting portion formed on the movement restricting portion, the inversion restricting portion restricting a displacement of the lock arm in an inverting direction opposite to the unlocking direction.

3. The connector of claim 2, wherein an unlocking surface for unlocking the lock arm from the lock by resiliently displacing the lock arm in the unlocking direction is formed on an outer surface of the connection detecting member, and the butting portions are disposed across the unlocking surface in a width direction intersecting the separating direction of the resilient locking piece and the front stop.

4. The connector of claim 3, wherein a turning surface for turning a forward pressing force applied to the connection detecting member from behind in the unlocking direction is formed on a rear part of the connection detecting member.

5. The connector of claim 4, wherein the movement restricting portion has a stopper surface configured to come into contact with a finger or tool pressing a pressing surface of the connection detecting member at the initial position when the connection detecting member is returned from the detection position to the initial position.

6. The connector of claim 5, wherein the second housing includes a tubular receptacle into which the first housing is fittable, and an entrance allowing portion facing the connection detecting member when the second housing is properly connected to the first housing and allowing entrance of the finger or tool by being recessed in a direction away from the pressing surface of the connection detecting member is provided at an opening edge of the receptacle.

7. The connector according to claim 6, wherein the pressing surface and the stopper surface are disposed substantially at the same position in the front-rear direction when the connection detecting member is at the initial position.

8. The connector of claim 5, wherein the pressing surface and the stopper surface are disposed substantially at the same position in the front-rear direction when the connection detecting member is at the initial position.

9. The connector of claim 1, wherein a turning surface for turning a forward pressing force applied to the connection detecting member from behind in the unlocking direction is formed on a rear part of the connection detecting member.

10. The connector of claim 1, wherein the movement restricting portion has a stopper surface configured to come into contact with a finger or tool pressing a pressing surface of the connection detecting member at the initial position when the connection detecting member is returned from the detection position to the initial position.

11. The connector of claim 10, wherein the second housing includes a tubular receptacle into which the first housing is fittable, and an entrance allowing portion facing the connection detecting member when the second housing is properly connected to the first housing and allowing entrance of the finger or tool by being recessed in a direction away from the pressing surface of the connection detecting member is provided at an opening edge of the receptacle.

12. The connector of claim 11, wherein the pressing surface and the stopper surface are disposed substantially at the same position in the front-rear direction when the connection detecting member is at the initial position.

13. The connector of claim 10, wherein the pressing surface and the stopper surface are disposed substantially at the same position in the front-rear direction when the connection detecting member is at the initial position.

* * * * *